US007264911B2

(12) United States Patent
Matsumura et al.

(10) Patent No.: US 7,264,911 B2
(45) Date of Patent: Sep. 4, 2007

(54) IMAGE FORMING APPARATUS AND IMAGE FORMING METHOD

(75) Inventors: Yasuo Matsumura, Minamiashigara (JP); Yukio Hara, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 386 days.

(21) Appl. No.: 10/912,288

(22) Filed: Aug. 6, 2004

(65) Prior Publication Data

US 2005/0170274 A1 Aug. 4, 2005

(30) Foreign Application Priority Data

Jan. 29, 2004 (JP) ..... 2004-021190

(51) Int. Cl.
*G03G 13/14* (2006.01)

(52) U.S. Cl. ..... 430/126; 399/252

(58) Field of Classification Search ..... 430/126; 399/252

See application file for complete search history.

(56) References Cited

U.S. PATENT DOCUMENTS

| | | | | |
|---|---|---|---|---|
| 6,416,918 | B2 * | 7/2002 | Matsumura et al. | 430/110.4 |
| 6,522,856 | B2 * | 2/2003 | Nakayama | 399/297 |
| 2003/0039913 | A1 * | 2/2003 | Kadokura et al. | 430/124 |

FOREIGN PATENT DOCUMENTS

| | | |
|---|---|---|
| JP | A 09-305038 | 11/1997 |
| JP | A 10-063115 | 3/1998 |
| JP | A 10-240020 | 9/1998 |
| JP | A 2002-162833 | 6/2002 |
| JP | A 2002-251077 | 9/2002 |
| JP | A 2003-057972 | 2/2003 |
| JP | A 2003-114545 | 4/2003 |

* cited by examiner

*Primary Examiner*—John L. Goodrow
(74) *Attorney, Agent, or Firm*—Oliff & Berridge, PLC

(57) ABSTRACT

The invention provides an image-forming apparatus equipped with a toner container containing toner particles and an endless belt circulating in contact with image carriers carrying electrostatic latent images. The image-forming apparatus forms a toner image on a recording medium by developing an electrostatic latent image on an image carrier by supplying the toner particles thereto, transferring the toner image onto the surface of the belt and finally onto the recording medium, and fixing the toner image thereon. When the particle count distribution in diameter ranges of the toner particles is expressed by Smaller-side grain size distribution index $GSDpS=(D50p/D16p)^{1/2}$, the toner container contains toner particles having a smaller-side grain size distribution index GSDpS of 1.24 or less; and the belt comprises a base support having a Young's modulus of 3,500 MPa or more and 9,000 MPa or less and a surface microhardness of 10 $mN/\mu m^2$ or less.

20 Claims, 3 Drawing Sheets

IMAGE FORMING APPARATUS AND IMAGE FORMING METHOD

BACKGROUND OF THE INVENTION

1. Field of the Invention

The present invention relates to an image-forming apparatus by so-called electrophotographic process, equipped with a toner container containing a set of toner particles and an endless belt circulating via certain transfer positions in contact with image carriers which carry electrostatic latent images, and to an image-forming method used in the image-forming apparatus.

2. Description of the Related Art

In image-forming apparatuses by the electrophotographic process such as copying machines and printers, an image carrier is first charged by an electrostatically charging device, before images are developed on the image carrier surface. Subsequently, an electrostatic latent image is formed on the surface of the image carrier, by exposing the image carrier to patterned light. Then, a toner image is formed on the image carrier by supplying the toner particles contained in the toner container onto the image carrier and developing the electrostatic latent image on the image carrier. The image is finally formed on a certain recording medium, by retransferring the toner image formed on the image carrier further onto the recording medium and fixing the image thereon. Some of these image-forming apparatuses employ an intermediate transfer belt method, wherein during transfer of the toner image formed on the image carrier onto a certain recording medium, the toner image is first transferred onto the surface of an endless belt circulating in a certain direction via the nip portions in contact with image carriers, and then the toner image transferred onto the surface of the belt is retransferred onto the recording medium. The intermediate transfer belt method is often employed, when multiple images in color are transferred one by one superimposed at the respective nip portions onto the surface of a belt (hereinafter, referred to as intermediate transfer belt) and the resulting superimposed multi-color image is transferred onto a recording medium.

Hitherto, elastic belts consisting of an woven fabric made of polyester or the like and an elastic layer formed thereon (see e.g., Japanese Patent Application Laid-Open (JP-A) No. 9-305038 and JP-A No. 10-240020, and others), and polyimide belts made of a polyimide resin superior in mechanical property and heat resistance (see e.g., JP-A No. 10-63115 and others) have been proposed as the intermediate transfer belts.

Recently, there exists a need for higher-image quality similar to photographic image quality in the copying machines and printers employing the electrophotographic process, while in image-forming apparatuses employing the intermediate transfer belt method, there is a need for prevention of out-of-color registration during the transfer of multiple images different in color one by one superimposed onto the intermediate transfer belt, and of scattering of toner particles (blur) during the transfer of the images onto the intermediate transfer belt.

In the image-forming apparatuses employing as the intermediate transfer belt an elastic belt described in Japanese Patent Application Laid-Open (JP-A) No. 9-305038 and JP-A No. 10-240020, the elastic layer of the intermediate transfer belt deforms along the surface of the image carrier and covers the toner particles on the image carrier, thus preventing the blur of toner particles, but due to an insufficient mechanical strength of the intermediate transfer belt, the belt is easily deformed by the stress applied during the belt movement, causing the out-of-color registration in the transfer region, i.e., at the nip portion. Thus, such image-forming apparatuses cannot provide the high-quality image demanded in recent years. Alternatively, in the image-forming apparatus employing an conductive polyimide belt described in JP-A NO. 10-63115 as the intermediate transfer belt, because of its higher mechanical strength of the intermediate transfer belt, the belt does not deform by the stress of movement, and consistently provides high-quality images without out-of-color registration, but the surface of the belt is too hard that the intermediate transfer belt cannot deform along the surface of the image carrier or cover the toner particles on image carrier with the belt at the nip portion, thus causing more frequent occurrence of the blur of toner particles. The frequency of the blur of toner particles depends also on the diameter of toner particles, and thus it is necessary to consider the properties of the intermediate transfer belt as well as the properties of toner particles, for obtaining high-quality images.

SUMMARY OF THE INVENTION

The present invention has been made in view of the above circumstances and provides an image forming apparatus that provides high-quality images, and an image-forming method used in the image-forming apparatus.

The image-forming apparatus according to the present invention, which achieves the object above, is an image-forming apparatus equipped with a toner container containing a set of toner particles and an endless belt circulating in a certain direction via nip portions in contact with image carriers carrying electrostatic latent images, that forms a toner image on a recording medium by obtaining a toner image by developing an electrostatic latent image on an image carrier carrying an electrostatic latent image by supplying the toner particles contained in the toner container thereto, transferring the toner image onto the surface of the belt at the nip portion, and transferring the toner image transferred onto the surface of the belt finally onto the recording medium and fixes the toner image thereon, wherein when the particle count distribution in diameter ranges of the toner particles contained in the toner container is expressed by Formula 1:

$$\text{Smaller-side grain size distribution index } GSDpS = (D50p/D16p)^{1/2} \qquad \text{Formula 1}$$

(wherein, D50p is the particle diameter at a cumulative count rate of 50% when toner particles are counted from the smallest toner particle cumulatively, and D16p is the particle diameter at a cumulative count rate of 16%.), the toner container contains a set of toner particles having a smaller-side grain size distribution index GSDpS of 1.24 or less; and the belt comprises a base support having a Young's modulus of 3,500 MPa or more and 9,000 MPa or less and a surface microhardness of 10 mN/$\mu m^2$ or less.

In the image-forming apparatus according to the present invention, the intermediate transfer belt is provided with a suitable mechanical strength by the base support above and with a suitable surface hardness by the elastic layer above. Hence, if the Young's modulus of the base support is below 3,500 MPa, the intermediate transfer belt deforms by the stress of belt movement due to insufficient mechanical strength, causing out-of-color registration. On the other hand, the Young's modulus of the base support is over 9,000

MPa, the belt does not travel smoothly due to excessively high mechanical strength. If the surface microhardness of the elastic layer is over 10 mN/μm$^2$, the intermediate transfer belt does not deform according to the surface of image carriers at the nip portions, and thus the toner particles on the image carriers are not covered by the intermediate transfer belt, causing more frequent incidence of blur. Further, among the toner particles contained in the toner container, relatively larger toner particles are held more tightly between an image carrier and the intermediate transfer belt at the nip portion and thus less easily scattered, while smaller toner particles are less tightly held there and vulnerable to scattering. For that reason, in the image-forming apparatus according to the present invention, the particle count distribution in diameter ranges of the toner particles contained in the toner container is expressed by a parameter, i.e., smaller-side grain size distribution index GSDpS, which is determined by the counts only of smaller toner particles. If the smaller-side grain size distribution index GSDpS is larger than 1.24, relatively smaller toner particles are present in a greater amount in the toner container, leading to higher incidence of the blur of toner particles when the intermediate transfer belt has the configuration described above.

For the reason, the image-forming apparatus according to the present invention allows prevention of out-of-color registration and the incidence of the blur of toner particles during image transfer, thus providing high-quality images.

The image-forming method according to the present invention, which achieves the object above, is an image-forming method that forms a toner image onto a recording medium, including a development step of obtaining a toner image by developing an electrostatic latent image on an image carrier carrying the electrostatic latent image by supplying a toner thereto; a transferring step of transferring the toner image onto an endless belt circulating in a certain direction via a nip portion in contact with the image carrier surface; and a retransferring step of retransferring the toner image transferred on the surface of the belt finally onto the recording medium and fixing the toner image thereon, wherein when the particle count distribution in diameter ranges is expressed by Formula 5:

$$\text{Smaller-side grain size distribution index } GSDpS = (50p/D16p)^{1/2} \qquad \text{Formula 5,}$$

(wherein, D50p is the particle diameter at a cumulative count rate of 50% when the number of toner particles is counted from the smallest toner particle cumulatively, and D16p is the particle diameter at a cumulative count rate of 16%.), the toner image is obtained by developing the electrostatic latent image by supplying toner particles having a smaller-side grain size distribution index GSDpS of 1.24 or less to the image carrier carrying the electrostatic latent image in the developing step, and the toner image is transferred at the nip portion onto the surface of the belt comprising a base support having a Young's modulus of 3,500 MPa or more and 9,000 MPa or less and having a surface microhardness of 10 mN/μm$^2$ or less in the transferring step.

The present invention provides an image-forming apparatus forming high-quality images and an image-forming method used in the image-forming apparatus.

BRIEF DESCRIPTION OF THE DRAWINGS

Preferred embodiments of the present invention will be described in detail based on the following figure, wherein.

DETAILED DESCRIPTION OF THE INVENTION

Hereinafter, an embodiment of the present invention will be described in detail with reference to Figures.

Figure 1:
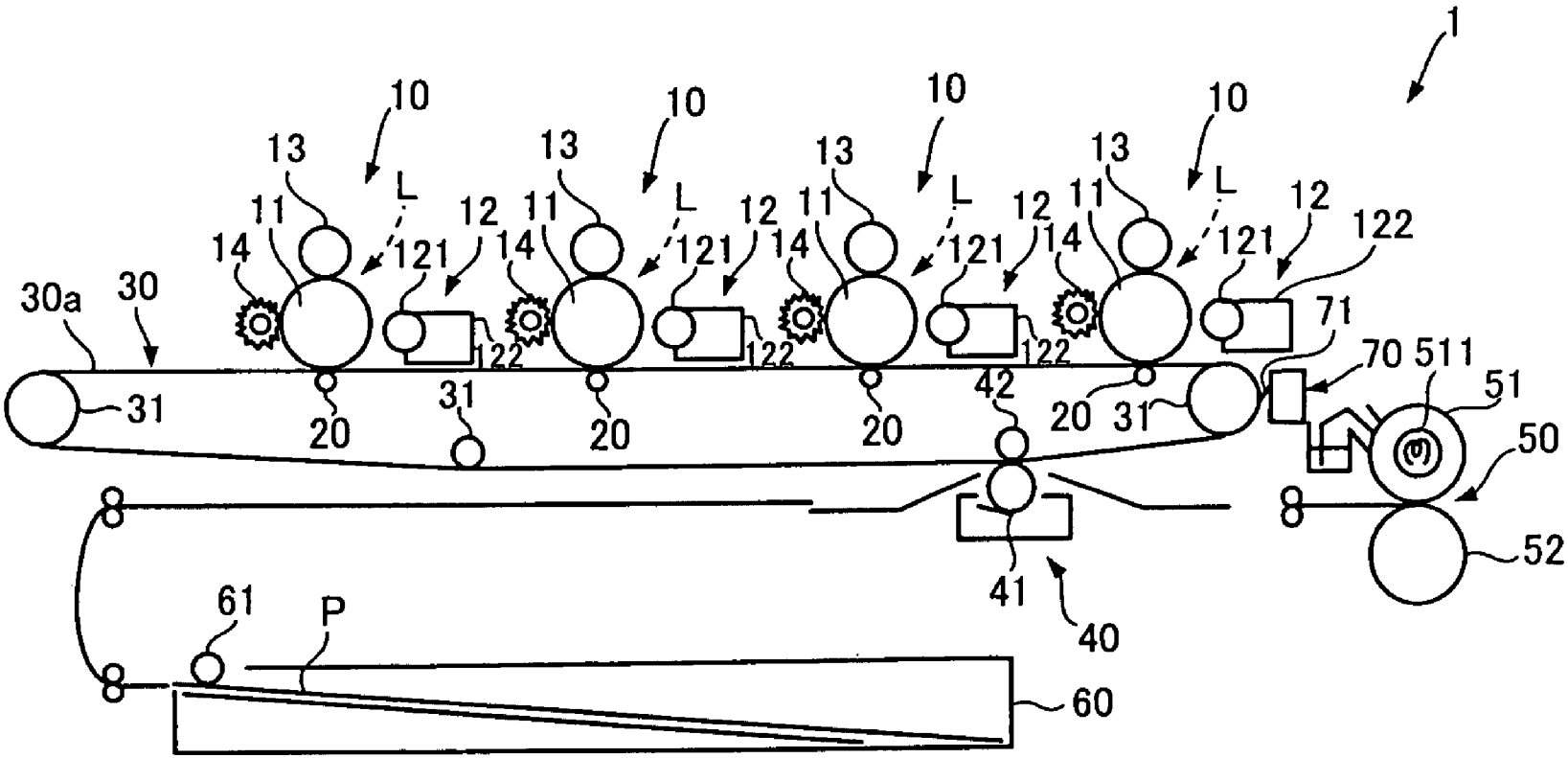
FIG. 1 is a schematic view illustrating an embodiment of an image-forming apparatus according to the present invention.

FIG. 1 is a schematic drawing illustrating the configuration of an embodiment of the image-forming apparatus according to the present invention.

An image-forming apparatus 1 shown in FIG. 1 is a full-color tandem image-forming apparatus, that, by using four toner image-forming units corresponding respectively to four toners in yellow, magenta, cyan, and black, forms four toner images different in color respectively by the toner image-forming units operating in synchronization with the traveling intermediate transfer belt, superimposes these toner images on the intermediate transfer belt (primary transfer), and then transfers and fixes the superimposed image onto a paper (secondary transfer).

The image-forming apparatus 1 shown in FIG. 1 has four toner image-forming units 10, four primary transfer rolls 20, a semiconductive intermediate transfer belt 30 circularly traveling counterclockwise supported by three supporting rolls 31, a final transfer device 40 for conducting secondary transfer, and a fixing device 50 for fixing the transferred unfixed toner image onto a paper. The intermediate transfer belt 30 shown in FIG. 1 corresponds to an example of the belt according to the present invention.

The four toner image-forming units 10 are placed tandem in the traveling direction of the intermediate transfer belt 30 and each toner image-forming unit 10 has a multi-layered photosensitive drum 11 rotating clockwise. The surface **30*a* of the intermediate transfer belt 30 is in contact with the surface of each of the photosensitive drums 11. In nip portions, where the intermediate transfer belt 30 is brought into contact with the photosensitive drums 11, primary transfer rolls 20 are placed on the side of the intermediate transfer belt 30 opposite to the respective photosensitive drums 11**.

Each toner image-forming unit 10 also has a contact-type electrostatically charging device 13 as well as a developing device 12 and a cleaning brush 14. The developing device 12 is placed upstream of the primary transfer region on the surface of the photosensitive drum 11. The contact-type electrostatically charging device 13 is placed further upstream of the developing device 12. In addition, the cleaning brush 14 is placed downstream of the primary transfer region on the surface of the photosensitive drum 11.

Hereinafter, the image-forming apparatus 1 shown in FIG. 1 will be described in more detail with reference to both FIGS. 1 and 2, together with description about the image-forming method used in the image-forming apparatus 1 shown in FIG. 1.

Figure 2:
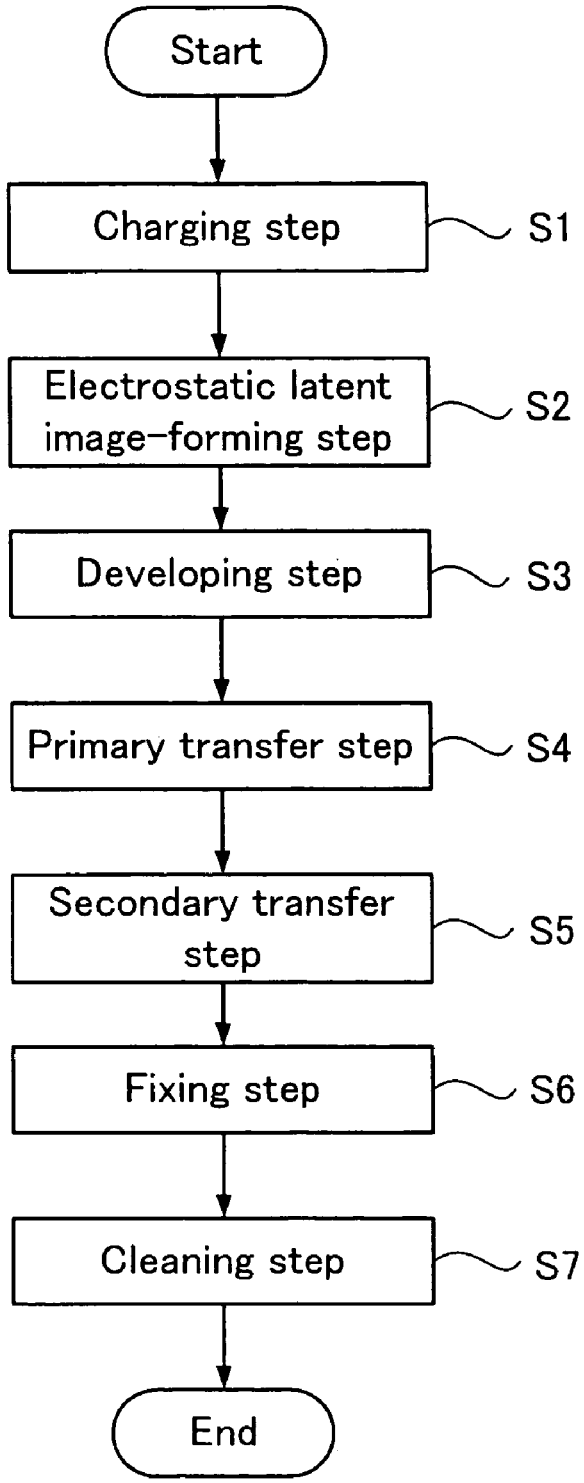
FIG. 2 is a flow chart illustrating an image-forming method carried out in the image-forming apparatus shown in FIG. 1.

FIG. 2 is a flow chart illustrating the image-forming method employed in the image-forming apparatus shown in FIG. 1.

First, the surface of the photosensitive drum 11 is charged uniformly with the contact-type electrostatically charging device 13 (charging step S1 shown in FIG. 2). Subsequently, a laser beam L is irradiated onto the surface of the photosensitive drum 11 uniformly charged with the contact-type electrostatically charging device 13, to form an electrostatic latent image on the surface of the photosensitive drum 11 (electrostatic latent image-forming step S2 shown in FIG. 2).

The developing device 12 has a magnetic roll 121 and a toner container 122 containing a two-component developer having a magnetic carrier and a nonmagnetic toner negatively charged with respect to a certain reference bias. A developer layer wherein the carriers, whereto the toner particles contained in the toner container 122 are adhered, are sticking outward like brush bristles (so-called magnetic brush) is formed on the external surface of the magnetic roll 121. In developing step S3 after the electrostatic latent image-forming step S2, the electrostatic latent image is developed into a toner image by the nonmagnetic toner particles transferred from the developer layer to the surface of the photosensitive drum 11 carrying the electrostatic latent image.

A transfer bias having the polarity opposite to that of the toner particles (here, polarity bias positive with respect to a certain reference bias) is applied to the primary transfer roll 20. In the primary transfer step S4 after the developing step S3, the toner image formed on the surface of the photosensitive drum 11 is transferred from the photosensitive drum surface onto the surface 30*a* of the intermediate transfer belt 30 at the nip portion where the intermediate transfer belt 30 is brought into contact with the photosensitive drum 11. Thus, the nip portion becomes the primary transfer region, and the primary transfer step S4 is an example of the transferring step according to the present invention. The toner images formed respectively in toner image-forming units 10 are superimposed to a single toner image on the surface 30*a* of the intermediate transfer belt 30.

The final transfer device 40 has a secondary transfer roll 41 which is placed on the side in contact with the surface 30*a* of the intermediate transfer belt 30 (toner image-carrying face) and a backup roll 42 which is placed on the reverse side of the intermediate transfer belt 30, and hold the intermediate transfer belt 30 between the two rolls 41 and 42. The region held between these two rolls 41 and 42 is the secondary transfer region.

The image-forming apparatus 1 shown in FIG. 1 has additionally a paper tray 60, and papers P contained in the paper tray 60 are fed one by one with a feed roll 61 from the paper tray 60 to the secondary transfer region at a certain timing. In the secondary transfer region, a single superimposed toner image is transferred onto a paper P fed onto the intermediate transfer belt 30 (secondary transferring step S5 shown in FIG. 2).

The fixing device 50 has a fixing roll 51 having a heating mechanism 511 inside and a pressure roll 52 placed at a position facing the fixing roll 51. The paper P processed in the secondary transfer region is conveyed into the slit between the mutually facing fixing roll 51 and pressure roll 52. In the fixing step S6, the toner particles in the toner image on the paper P are fused and fixed on the paper P by the heat from the heating mechanism 511 of fixing roll 51.

Although the secondary transferring step S5 precedes the fixing step S6 in the image-forming apparatus 1 shown in FIG. 1, the image may be formed in a simultaneous step combining the steps S5 and S6.

In addition, a belt cleaner 70 for removing toner particles remaining on the intermediate transfer belt 30 is placed downstream of the final transfer device 40. The belt cleaner 70 has a rubber blade 71. The edge of the blade 71 is in contact with the surface 30*a* of the intermediate transfer belt 30, by which the toner particles remaining on the surface 30*a* are removed as the intermediate transfer belt 30 circulates.

In the image-forming apparatus 1 shown in FIG. 1, so-called cleanerless system, wherein a cleaning blade in contact with the photosensitive drum 11 is eliminated, is shown. Namely, to the cleaning brush 14 shown in FIG. 1, a recovery bias for recovery of toner particles that are not transferred onto the intermediate transfer belt 30 and remain on the photosensitive drum 11 in the primary transfer region (here, polarity bias positive with respect to a certain reference bias), and a releasing bias for releasing the recovered toner particles back onto the photosensitive drum 11 (here, polarity bias negative with respect to the certain reference bias) are applied. During image formation, the recovery bias is applied to the cleaning brush 14 for recovering and storing toner particles remaining on the photosensitive drum 11 in the cleaning brush 14 temporarily (cleaning step S7 shown in FIG. 2), and the releasing bias is applied to the cleaning brush 14 during interruptions of image formation for releasing the recovered and stored toner particles back onto the photosensitive drum 11. Toner particles released back to the photosensitive drum 11 are transferred onto the intermediate transfer belt 30 at the primary transfer region, and ultimately removed from the intermediate transfer belt 30 by the belt cleaner 70.

Subsequently, the intermediate transfer belt shown in FIG. 1 will be described in more detail with reference to FIG. 3.

Figure 3:
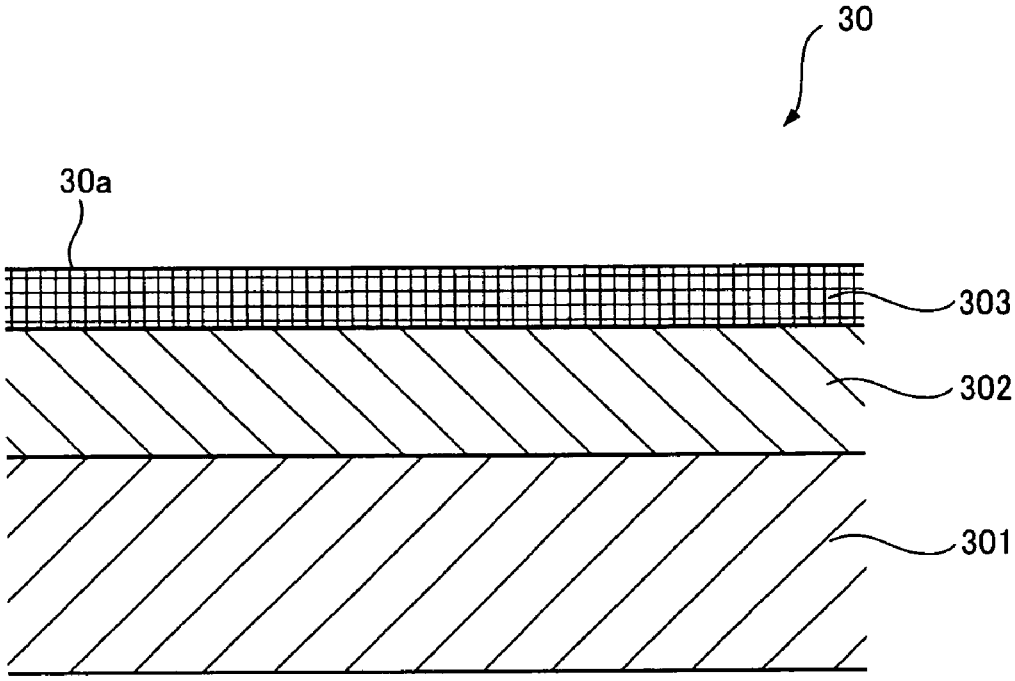
FIG. 3 is a schematic cross-sectional view of the intermediate transfer belt shown in FIG. 1.

FIG. 3 is a schematic drawing illustrating the cross section of the intermediate transfer belt shown in FIG. 1.

The intermediate transfer belt 30 shown in FIG. 3 is an endless belt having a multilayer structure consisting of a base support 301, an elastic layer 302, and a surface layer 303.

The base support 301 is a seamless belt made of a polyimide, polyamide, polyether ether ester, polyarylate, polyester, or reinforced polyester resin, or the like. The Young's modulus of the base support 301 is 3,500 MPa or more and 9,000 MPa or less, preferably 4,000 MPa or more and 8,000 MPa or less, and still more preferably 4,000 MPa or more and 7,500 MPa or less. If the Young's modulus of the base support is less than 3,500 MPa, the intermediate transfer belt 30 is insufficient in rigidity and thus may be deformed by the stress of belt movement, leading to out-of-color registration. On the other hand, if the modulus is over 9,000 MPa, the base support is excessively high in mechanical strength, and thus not only impairs smooth traveling of the belt, but also increases the stress to toner powders for toner images, leading to higher incidence of disconnection of linear images (hollow character) and scattering of toner particles (blur) during transfer.

The Young's modulus is determined according to JIS K6251 by cutting the semiconductive belt into the shape of JIS No. 3, obtaining a stress-strain curve by supplying the test piece to a tensile test, and measuring the slope of a line drawn tangent to the curve in the initial strain region.

Hereinafter, a base support made of a polyimide resin, which is superior in mechanical properties, will be described in detail. Polyimide resins are, for example, resins prepared by the reaction of an aromatic tetracarboxylic acid component and an aromatic diamine component in an organic polar solvent.

Examples of the aromatic tetracarboxylic acid components include pyromellitic acid, naphthalene-1,4,5,8-tetracarboxylic acid, naphthalene-2,3,6,7-tetracarboxylic acid, 2,3,5,6-biphenyltetracarboxylic acid, 2,2',3,3'-biphenyltetracarboxylic acid, 3,3',4,4'-biphenyltetracarboxylic acid, 3,3',4,4'-diphenylethertetracarboxylic acid, 3,3',4,4'-benzophenonetetracarboxylic acid, 3,3',4,4'-diphenylsulfonetetracarboxylic acid, 3,3',4,4'-azobenzenetetracarboxylic acid, bis(2,3-dicarboxyphenyl) methane, bis(3,4-dicarboxyphenyl)methane, β, β-bis(3,4-dicarboxyphenyl)propane, β, β-bis(3,4-dicarboxyphenyl) hexafluoropropane, and the like, and these tetracarboxylic acids may be used as a mixture. The aromatic diamine components include, but are not particularly limited to, m-phenylenediamine, p-phenylenediamine, 2,4-diaminotoluene, 2,6-diaminotoluene, 2,4-diaminochlorobenzene, m-xylylenediamine, p-xylylenediamine, 1,4-diaminonaphthalene, 1,5-diaminonaphthalene, 2,6-diaminonaphthalene, 2,4'-diaminobiphenyl, benzidine, 3,3-dimethylbenzidine, 3,3'-dimethoxybenzidine, 3,4'-diaminodiphenylether, 4,4'-diaminodiphenylether (oxy-p,p'-dianiline: ODA), 4,4'-diaminodiphenylsulfide, 3,3'-diaminobenzophenone, 4,4'-diaminophenylsulfone, 4,4'-diaminoazobenzene, 4,4'-diaminodiphenylmethane, β, β-bis(4-amino phenyl) propane, and the like. The organic polar solvents include, for example, N-methyl-2-pyrrolidone, N,N-dimethylacetamide, dimethylsulfoxide, hexamethylphophosphoric triamide, and the like. Phenols such as cresol, phenol, xylenol, and the like; and hydrocarbons such as hexane, benzene, toluene, and the like may be added to these organic polar solvents. These solvents may be used alone or as a mixture of two or more solvents.

It is preferable to disperse a conductive agent in the polyimide resin used for the base support 301. Examples of the conductive agents include carbon blacks such as Ketjen black and acetylene black; metals such as aluminum and nickel; metal oxide compounds such as tin oxide; conductive or semiconductive fine particles such as potassium titanate, and preferable conductive agents among them are acidic carbon blacks treated at pH 5 or lower. However, the conductive agents are not limited to these examples, and any materials may be used if they can provide desirable electric resistance consistently. These materials may be used alone or in combination.

The material for the elastic layer 302 is not particularly limited, if it has a JIS A hardness of 40 to 70° C. and a volumetric resistivity of $10^8$ to $10^{13}$ Ωcm, and one or a blend of two or more selected from polyurethane, chlorinated polyisoprene, NBR, chloroprene rubber, EPDM, hydrogenated polybutadiene, butyl rubber, silicone rubber, and the like may be used. It is preferable to add one or a mixture of two or more conductive agents to these materials as needed for improvement in electronic and/or ionic conductivity. If a rubber material is used for the elastic layer 302, the material is preferably not in the shape of liquid or paste, but in the form of unvulcanized-rubber solid sheet. The unvulcanized rubber can be applied into the sheet form accurately for example with a calendar roll or the like, and the resulting sheet is used as it is. A laminated solid rubber belt having a two-layered structure consisting of a base support and an elastic layer, which is superior in adhesiveness to the base support, may be obtained by forming a solid rubber sheet, laminating the solid rubber onto a base support, and integrally molding the laminate into a seamless belt.

The surface layer 303 is made of, for example, a nonadhesive resin composition containing a fluorine resin material as the main component. Examples of the fluorine resins include polytetrafluoroethylene, tetrafluoroethylene, copolymers thereof with at least one other copolymerizable ethylenic unsaturated monomer (e.g., olefins such as ethylene and propylene; halogenated olefins such as hexafluoropropylene, vinylidene fluoride, chlorotrifluoroethylene, and vinyl fluoride; perfluoroalkylvinylethers, and the like), polychlorotrifluoroethylene, polyvinylidene fluoride, and the like. Particularly preferable fluorine resins are polytetrafluoroethylene; copolymers of tetrafluoroethylene and at least one fluorine monomer selected from hexafluoropropylene, perfluoromethylvinylether, perfluoroethylvinylether and perfluoropropylvinylether (commonly at an amount of 40 mole % or less with respect to tetrafluoroethylene); and the like.

It is also preferable to add a conductive agent to the resin material for the surface layer 303. Conductive agents similar to those added to the base support may be used as the conductive agent above, but fluorinated carbons prepared by fluorinating conductive carbon black with fluorine gas are favorably used.

The volumetric resistivity of the surface layer 303 is preferably $1\times10^8$ to $1\times10^{13}$ Ωcm and more preferably $1\times10^9$ to $1\times10^{12}$ Ωcm. If the volumetric resistivity is less than $1\times10^8$ Ωcm, electrostatic force of the unfixed toner images transferred from the photosensitive drum 11 shown in FIG. 1 onto the intermediate transfer belt 30 for retaining the electric charge becomes less effective, and accordingly the toner particles are scattered around the image portion, sometimes providing images higher in noise, due to the electrostatic repulsion among toner particles and the force by the fringe electric field near the image edges. On the other hand, if the volumetric resistivity is larger than $1\times10^{13}$ Ωcm, toner particles has a greater ability to retain the electric charge, and thus the surface of the intermediate transfer belt is charged in the transfer electric field applied during the primary transfer, sometimes requiring an additional discharging mechanism. Therefore, proper adjustment of the volumetric resistivity in the range above eliminates the problems of the scattering of toner particles and the requirement for an additional discharging mechanism.

The total thickness of the two-layers, surface layer 303 and elastic layer 302, is 10 to 80% with respect to the total thickness of the intermediate transfer belt 30. The hardness of the surface 30*a* of intermediate transfer belt 30 shown in FIG. 3 (transfer face) is preferably 10 mN/μm$^2$ or less, more preferably 8 mN/μm$^2$ or less, as surface microhardness.

The surface microhardness is not determined by measuring the length of the diagonal line of a hole generated by an indenter, for example, in measurement of Vickers' hardness which is widely used for measurement of the hardness of metal materials or the like, but by measuring the depth an indenter has penetrated into a sample. When the test load is designated as P (mN) and the depth of the indenter penetration into a sample (penetration depth) as D (μm), the surface microhardness DH is defined by the following formula:

$$DH=\alpha P/D^2$$

Here, α is a constant depending on the shape of the indenter and is 3.8584 when a triangular pyramid indenter is used.

The surface microhardness DH, a hardness obtained from the load during an indenter is pushed inward and the penetration depth, represents strength characteristics of the material in the state including plastic as well as elastic deformation thereof. As the area needed for measurement is very small, it is possible to determine the surface microhardness more accurately in the range close to the diameter of toner particles. The inventors have found the surface microhardness thus obtained has an accurate correlation with the incidence of the blur of toner particles and the disconnection of linear images (hollow character). The surface microhardness of the surface of the intermediate transfer belt 30 (transfer face) is preferably 10 $mN/\mu m^2$ or less, more preferably 8 $mN/\mu m^2$ or less. If the surface microhardness is in the range above, the transfer face of the intermediate transfer belt 30 is deformed by the pressure applied by the primary transfer roll 20 in the primary transfer region; therefore, the toner particles on the photosensitive drum 11 are covered by the intermediate transfer belt 30, suppressing the blur of toner particles; and the pressure concentrated on the toner images carried on the photosensitive drum 11 is spread more widely, suppressing generation of hollow characters.

The surface microhardness of the transfer face of an intermediate transfer belt 30 is determined by the following method. The intermediate transfer belt 30 is cut into pieces of about 5 mm square, and the test sample is fixed on a glass plate with an instant adhesive. The surface microhardness of the surface of the small test piece fixed on a glass plate is determined by using an ultra-microhardness tester DUH-201S (manufactured by Shimadzu Corporation).

The measuring conditions are as follows:

Measuring environment: 23° C., 55% RH
Indenter used: Triangular pyramid indenter
Test mode: 3 (test for soft materials)
Test load: 0.70 gf
Loading speed: 0.0145 gf/sec
Test period: 5 sec The surface microhardness of the transfer face of the intermediate transfer belt 30 is largely dependent on the material used for the elastic layer 302 and the ratio of the thickness of the two layers, surface layer 303 and elastic layer 302, to the total thickness of the intermediate transfer belt 30. The materials suitable for the elastic layer 302 has already been described, and the ratio of the thickness of two layers, surface layer 303 and elastic layer 302, is 10 to 80% with respect to the total thickness of the intermediate transfer belt 30. The total thickness of the intermediate transfer body belt 30 is 0.05 to 0.5 mm, preferably 0.06 to 0.30 mm, and more preferably 0.06 to 0.15 mm.

In addition, the friction coefficient of the surface layer 303 is preferably 0.5 or less, and more preferably 0.2 to 0.4. If the friction coefficient is over 0.5, once a stress is generated by the photosensitive drum 11, the resulting stick slip with the photosensitive drum 11 causes minor deformation of the transfer face of intermediate transfer belt 30, leading to deterioration in the quality of fine transferred images.

The friction coefficient can be determined by preparing a film of 20 μm in thickness with the material used for the surface layer 303, and measuring the friction thereof in a static and dynamic friction meter (manufactured by Kyowa Interface Science Co., Ltd) by using the film as the test sample.

Measuring conditions are as follows:

Steel ball used: 3 mm in diameter
Movement speed: 0.1 cm/sec
Load: 100 g

As described above, the intermediate transfer belt 30 shown in FIG. 3 has superior characteristics including no deterioration in resistance due to the transfer voltage applied, no problems such as deformation of the shape over time, independence from the electric field applied, and smaller change in electric resistance caused by the environment. The intermediate transfer belt 30 hitherto described has a three-layer structure consisting of a base support 301, an elastic layer 302, and a surface layer 303, but the intermediate transfer belt may have a multilayer structure higher in multiplicity within the scope of the present invention. As described above, it is preferable to add a conductive agent to each of these layers, and further other additives different from the conductive agent may also be added thereto.

Subsequently, the developer stored in the toner container 122 shown in FIG. 1 will be described in detail.

Toner particles prepared by emulsion-polymerization-flocculation process are favorably stored in the toner container 122 shown in FIG. 1. The emulsion-polymerization-flocculation process is a method consisting of the steps of: preparing a resin dispersion wherein binder resin particles are dispersed for example by emulsion polymerization or the like; preparing separately a coloring agent dispersion wherein an coloring agent is dispersed in a solvent; forming coagulation particles having a particle diameter similar to that of the toner particles by mixing the resin dispersion and the coloring agent dispersion; and subsequently fusing the coagulation particles by heating, and usually allows more efficient preparation of smaller-diameter toner particles, as fine particles having a diameter of 1 μm or less are used as the starting material.

Examples of the binder resins include homopolymers and copolymers of styrenes such as styrene and p-chlorostyrene; vinyl esters such as vinylnaphthalene, vinyl chloride, vinyl bromide, vinyl fluoride, vinyl acetate, vinyl propionate, vinyl benzoate, and vinyl butyrate; methylene aliphatic carboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, α-chloromethyl acrylate, methyl methacrylate, ethyl methacrylate, and butyl methacrylate; acrylonitrile; methacrylonitrile; acrylamide, vinyl ethers such as vinylmethylether, vinylethylether, and vinylisobutylether; monomers having an N-containing polar group such as N-vinyl compounds including N-vinylpyrrole, N-vinylcarbazole, N-vinylindole, and N-vinylpyrrolidone; vinyl monomers such as vinylcarboxylic acids including methacrylic acid, acrylic acid, cinnamic acid, and carboxyethyl acrylate. The examples thereof also include various polyesters and various waxes.

If a vinyl monomer is used, the resin dispersion can be prepared in an emulsion polymerization by using an ionic surfactant or the like. Alternatively, if an other resin is used and is soluble in an oily, water-insoluble solvent, the resin dispersion can be prepared by dissolving the resin in a suitable solvent; dispersing the solution in water in the form of fine particles together with an ionic surfactant and an polymer electrolyte by using a dispersing machine such as a homogenizer; and then removing the solvent under heat or under reduced pressure.

The average diameter (median diameter) of the resin particles in the resin dispersion thus obtained is 1 μm or less, preferably 50 to 400 nm, and more preferably in the range of 70 to 350 nm. The average diameter of the resin particles is determined, for example, by a laser-diffraction particle size distribution-measuring device (LA-700, manufactured by Horiba, Ltd.).

Examples of the coloring agents include pigments or dyes in various colors. Black pigments include carbon black, copper oxide, manganese dioxide, aniline black, activated carbon, nonmagnetic ferrite, magnetite, and the like.

Yellow pigments include chrome yellow, zinc yellow, yellow iron oxide, cadmium yellow, chromium yellow, Hanza Yellow, Hanza Yellow 10G, Benzidine Yellow G, Benzidine Yellow GR, threne yellow, quinoline yellow, Permanent Yellow NCG, and the like.

Orange pigments include red chrome yellow, molybdate orange, Permanent Orange GTR, pyrazolone orange, Vulcan Orange, Benzidine Orange G, Indanthren Brilliant Orange RK, Indanthren Brilliant Orange GK, and the like.

Red pigments include bengala, cadmium red, red lead, mercury sulfide, Watchung Red, Permanent Red 4R, Lithol Red, Brilliant Carmine 3B, Brilliant Carmine 6B, Du Pont oil red, pyrazolone red, Rhodamine B Lake, Lake Red C, rose bengal, eoxine red, alizarin lake, naphthol red pigments such as Pigment Red 146, 147, 184, 185, 155, 238, and 269, and the like.

Blue pigments include iron blue, cobalt blue, alkali blue lake, Victoria blue lake, Fast Sky Blue, Indanthren blue BC, aniline blue, ultramarine blue, Calco Oil blue, methylene blue chloride, phthalocyanine blue, phthalocyanine green, malachite green oxalate, and the like.

Purple pigments include manganese purple, Fast Violet B, methyl violet lake, and the like.

Green pigments include chromium oxide, chromium green, Pigment Green, malachite green lake, Final Yellow Green G, and the like.

White pigments include zinc white, titanium oxide, antimony white, zinc sulfide, and the like.

Further, the dyes include various dyes including basic, acidic, dispersion, and direct dyes and the like, and examples thereof include nigrosin, methylene blue, rose bengal, quinoline yellow, ultramarine blue, and the like.

These coloring agents may be used alone or in combination. Dispersions of the colorant particles may be obtained with these coloring agents, for example, by using a dispersing machine containing a dispersing medium such as a rotary shearing homogenizer, ball mill, sandmill, or attritor; a high-pressure counter-collision dispersing machine, or the like. Alternatively, these coloring agents may be dispersed in water in a homogenizer by using a polar surfactant.

The coloring agents are suitably selected from the viewpoints of hue angle, color saturation, brightness, weather resistance, OHP transparency, and dispersibility. The coloring agent may be added in an amount in the range of 4 to 15% by weight with respect to the total weight of the solid matters in the toner. Different from other coloring agents, when a magnetic particle is used as the black coloring agent, the particles may be added in an amount of 12 to 240% by weight. The amount of the coloring agents blended is favorably the minimum amount required for ensuring coloring in the fixing step.

Colorant particles in toner having an average diameter (median diameter) adjusted in the range of 100 to 330 nm ensure the OHP transparency and coloring of the formed images. The average diameter of colorant particles is determined, for example, by a laser-diffraction grain size distribution-measuring device (LA-700, manufactured by Horiba, Ltd.).

In addition, an internal additive, charge controlling agent, releasing agent, or the like may also be added to the toner particles contained in the toner container 122 of FIG. 1.

Examples of the internal additives include metals such as ferrite, magnetite, reduced iron, cobalt, nickel, and manganese, the alloys thereof, and the magnetic particles prepared from the compounds containing these metals.

Examples of the charge controlling agents include various charge controlling agents commonly used, for example, quaternary ammonium salt compounds; nigrosin compounds; dyes prepared from aluminum, iron, and chromium complexes; and triphenylmethane pigments, and among them, materials less soluble in water are favorable from the viewpoints of controlling the ionic strength, which may affects coagulation and the stability in the fixing step, and reducing wastewater pollution.

Examples of the releasing agents include low-molecular weight polyolefins such as polyethylene, polypropylene, and polybutene; silicones that soften easily by heating; fatty acid amides such as oleic amide, erucic amide, recinoleic amide, and stearic amide; vegetable waxes such as carnauba wax, rice wax, candelilla wax, Japan tallow, and jojoba oil; animal waxes such as beeswax and the like; mineral-petroleum waxes such as montan wax, ozokerite, ceresin, paraffin wax, microcrystalline wax, and Fischer-Tropsch wax; and the modified materials thereof. These waxes are hardly or scarcely soluble in solvents such as toluene around room temperature. These waxes are dispersed in water together with a polymer electrolyte, such as an ionic surfactant, polymeric acid, polymeric base, or the like, and may be further dispersed into the form of fine particles, by dispersing the solution at a temperature higher than the melting point of the waxes under high shearing force in a homogenizer or high-pressure extrusion dispersing machine (Gaulin homogenizer, manufactured by APV Gaulin). In this manner, releasing agent dispersions containing releasing agent particle having a diameter of 1 μm or less may be obtained.

The dispersion may additionally contain a polymerizable UV-resistant monomer or the like as needed, for improvement in the weather resistance or the like of images. Examples of the more effective polymerizable UV-resistant monomers are piperidine compounds such as 4-(meth)acrlyloyloxy-2,2,6,6-tetramethylpiperidine, 4-(meth)acrlyloylamino-2,2,6,6-tetrapiperidine, 4-(meth)acrlyloyloxy-1,2,2,6,6-pentamethylpiperidine, 4-(meth)acrlyloylamino-1,2,2,6,6-pentamethylpiperidine, 4-cyano-4-(meth)acrlyloylamino-2,2,6,6-tetramethylpiperidine, 1-(meth)acrlyloyl-4-(meth)acrlyloylamino-2,2,6,6-tetramethylpiperidine, and the like. These compounds may be used alone or in combination of two or more.

The amount of these releasing agents added is preferable in the range of 5 to 25% by weight with respect to the total weight of the solid matters in the toner, for ensuring the releasability of the fixed image in oil less fusing systems. If a releasing agent is used, it is preferable first to prepare coagulation particles from resin, colorant, and releasing agent particles and then to coat the surface of the coagulation particles with resin particles by applying the resin dispersion, for ensuring suitable electrostatic properties and durability of the particles.

Additionally, a surfactant may be used for emulsion polymerization of the binder resins, dispersion of pigments, dispersion of resin particles, dispersion of the releasing agent, coagulation, stabilization of coagulation particles, and the like. Examples of the surfactants include anionic surfactants such as sulfuric acid ester salts, sulfonic acid salts, phosphoric acid esters, and soaps; and cationic surfactants such as amine salts and quaternary ammonium salts. Combined use of a nonionic surfactant, such as a polyethylene glycol, alkyl phenol ethylene oxide adduct, polyvalent alcohol surfactant, or the like, is also effective. Anyone of commonly used dispersers, such as rotary shearing homogenizer; and ball mill, sand mill, and Dynomill containing a dispersing medium, may be used for dispersion.

After the coagulation particles are fused, desired toner particles are obtained via any washing step, solid-liquid separation step, or drying step. The toner particles are preferably washed thoroughly with ion-exchange water in the washing step, considering the electrostatic properties thereof. The solid-liquid separation step is not particularly limited, but the particles are preferably separated by filtration under reduced or higher pressure from the viewpoint of productivity. Further, the drying step is also not particularly limited, but freeze drying, flash jet drying, fluidized bed drying, vibrationally fluidized bed drying, and the like are preferably used from the viewpoint of productivity. For the purpose of improving fluidity and cleanability, fine particles of an inorganic compound such as silica, alumina, titania, or calcium carbonate, or fine particles of a resin such as a vinyl resin, polyester, or silicone may be added after drying to the toner particle surface under shearing force in the dry state. Alternatively, an inorganic particle may be attached onto the coagulation particle surface in water, and examples of the inorganic fine particles used in such a case include any materials that are commonly used as the external additive for the toner particle surface, such as silica, alumina, titania, calcium carbonate, magnesium carbonate, and tricalcium phosphate. These inorganic particles are used as dispersion, together with an ionic surfactant, polymeric acid, or polymeric base.

When the particle count distribution in diameter ranges of the toner particles contained in the toner container 122 shown in FIG. 1 is expressed in the following formula:

$$\text{Smaller-side grain size distribution index } GSDpS = (D50p/D16p)^{1/2} \qquad \text{Formula 1}$$

(wherein, a cumulative distribution curve is drawn from the smaller side, by using the number of toner particles classified according to grain ranges (channel) partitioned based on the grain size distribution, as determined for example by an analyzer such as Coulter Counter TAII (manufactured by Beckman Coulter), and Multisizer II (manufactured by Beckman Coulter), and the particle diameter at a cumulative count of 50% is defined as D50p, while the particle diameter at a cumulative count of 16%, D16p.), the value of the smaller-side grain size distribution index GSDpS is 1.24 or less. Among the toner particles contained in the toner container 122, relatively larger toner particles are less easily scattered, as they are held between the photosensitive drum 11 and the intermediate transfer belt 30 at the nip portion in the primary transfer region, while relatively smaller particles are more easily scattered, as they are not held there. If the smaller-side grain size distribution index GSDpS is over 1.24, the toner container 122 contains a greater amount of relatively smaller toner particles, and thus the toner particles may be scattered even if the intermediate transfer belt 30 is prepared as described above. The smaller-side grain size distribution index GSDpS is preferably 1.23 or less, and more preferably 1.22 or less. The control of the smaller-side grain size distribution index GSDpS is commonly done by classification, when the toner particles are prepared by commonly pulverization method. In the case of the toner particles prepared in the emulsion-polymerization-flocculation process, which does not have a common classification step, the grain size distribution index thereof may be controlled by making the coagulation conditions, such as heating temperature and stirring speed, more milder.

When a cumulative distribution is drawn from the smaller side using the number of toner particles classified according to grain ranges (channel) partitioned based on the grain size distribution as determined for example by an analyzer such as Coulter Counter TAII (manufactured by Beckman Coulter), and Multisizer II (manufactured by Beckman Coulter), and average particle diameter of the toner particles contained in the toner container 122 shown in FIG. 1 is defined as the particle diameter at a cumulative count of 50%, D50, D50 is preferably in the range of 3.0 to 9.0 μm. If D50 is less than 3.0 μm, the toner particle may become less vulnerable to electrification, leading to deterioration in developability. On the other hand, if it is over 9.0 μm, the resolution of images decrease. The cumulative volume-average particle diameter D50 is preferably in the range of 3.0 to 8.0 μm.

When flatness coefficient of the toner particles contained in the toner container 122 shown in FIG. 1 is defined in the following formula:

$$SF\text{-}1 = \{(MXLNG)^2/\text{AREA}\} \times (\pi/4) \times 100 \qquad \text{Formula 2}$$

(wherein, MXLNG in Formula 2 represents the maximum diameter of a toner particle, and AREA represents a projected area of the toner particle.), the flatness coefficient SF-1 is 140 or less. Toner particles contained in the toner container 122 more spherical in shape has a smaller contact area with the photosensitive drum 11, and thus a greater tendency to be transferred to the intermediate transfer belt 30, while those that deviate significantly from the spherical shape or are flattened have a greater contact area with the photosensitive drum 11 and thus a smaller tendency to be transferred to the intermediate transfer belt 30. If the flatness coefficient SF-1 is over 140, the toner container 122 contains a greater amount of toner particles deviated from the spherical shape and flattened, leading to decrease in the efficiency of transferring toners and the uniformity of images.

In addition, when surface roughness index of the toner particles contained in the toner container 122 shown in FIG. 1 is defined by the following Formula, $$\text{Surface roughness index} = \text{Measured specific surface area}/\text{Calculated specific surface area} \qquad \text{Formula 3}$$

(wherein, the calculated specific surface area is a value calculated according to the following Formula 4, using the particle count n and the particle diameter R of the toner particles falling in each of 16 grain ranges partitioned based on the number distribution of particle diameter as determined by using a Coulter counter, and the density of the toner particles ρ:

$$\text{Calculated specific surface area} = 6\Sigma(n \times R^2)/\{\rho \times \Sigma(n \times R^3)\} \qquad \text{Formula 4,}$$

the surface roughness index is 2.0 or less.) When the surface roughness of the toner particles contained in the toner container 122 is greater, the contact area of the toner particles with the photosensitive drum 11 increases, which also impairs the transfer of the toner particles onto the intermediate transfer belt 30. If the surface roughness index is over 2.0, the toner container 122 contains a greater amount of toner particles having a larger surface roughness, decreasing the transfer efficiency of the toner and uniformity of images. Although another parameter, called SF-2, is used elsewhere as a parameter for defining the surface roughness of toner particles, the parameter SF-2 often leads to errors due to its inherent problem in resolution, as the parameter is determined by analyzing the surface area of toner particles by using an optical microscope. In contrast, use of the surface roughness index above provides more accurate measured data, as it is obtained by analyzing absorption of a molecule on the toner particle surface for determining the surface area of toner particles.

Further, the apparent weight-average molecular weight of the toner particles contained in the toner container 122 shown in FIG. 1 is 15,000 to 55,000. If the weight-average molecular weight is less than 15,000, the coagulation capacity of the binder resin tends to decline, sometimes leading to decrease in oil-less releasability, while if it is over 55,000, the binder resin has a good oil-less releasability, but may become more resistant to the smoothing in the fixing step, resulting in decrease in the glossiness of formed images. The weight-average molecular weight is preferably in the range of 20,000 to 48,000.

Alternatively, the glass transition point Tg of the toner particles contained in the toner container 122 shown in FIG. 1 is preferably 45 to 70° C. If the Tg is less than 45° C., the coagulation capacity of the binder resins declines in the high-temperature range, more frequently causing hot offsets in the fixing step, and alternatively, if it is more than 70° C., the resins do not fuse sufficiently, resulting in decrease in glossiness of the fixed images. The glass transition point Tg is preferably in the range of 50 to 65° C.

The toner container 122 shown in FIG. 1 contains a carrier as well as the toner particle. The carrier is not particularly limited, and examples thereof include carriers known in the art, such as resin-coated carriers described, for example, in JP-A Nos. 62-39879 and 56-11461, and the like.

Typical examples of the carriers include the following resin-coated carriers. Namely, core particles for the carriers include common iron powder, ferrite, magnetite particles, and the like, and the average particle diameter thereof is about preferably in the range of 30 to 200 μm.

Examples of the coating resins for the core particles include homopolymers and copolymers of styrenes such as styrene, p-chlorostyrene, and α-methylstyrene; α-methylene fatty acid monoesters such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acrylics such as dimethylaminoethyl methacrylate; vinyl nitrites such as acrylonitrile and methacrylonitrile; vinyl pyridines such as 2-vinylpyridine and 4-vinylpyridine; vinyl ethers such as vinylmethylether and vinylisobutylether; vinyl ketones such as vinylmethylketone, vinylethylketone, and vinylisopropenylketone; olefins such as ethylene and propylene; vinyl fluorine-containing monomers such as vinylidene fluoride, tetrafluoroethylene, and hexafluoroethylene; and the like. Examples thereof also include silicones such as methylsilicone and methylphenylsilicone; polyesters containing bisphenol, glycol, and the like; epoxy resins, polyurethane resins, polyamide resins, cellulose resins, polyether resins, polycarbonate resins, and the like. These resins may be used alone or in combination of two or more.

The amount of the coating resin is preferably in the range of about 0.1 to 10 parts, more preferably in the range of about 0.5 to 3.0 parts by weight with respect to the core particle.

A heating kneader, heating Henschel mixer, UM mixer, or the like may be used for production of the carriers, and a heated fluidized bed, heated kiln may also be used, depending on the amount of the coating resins.

The developer contained in the toner container 122 shown in FIG. 1 is a bicomponent developer containing a toner particle and a carrier, but may be a unicomponent developer containing only a toner particle. In addition, the toner particles contained in the toner container 122 shown in FIG. 1 are nonmagnetic toner particles, but may contain magnetic toner particles.

Hereinafter, the present invention will be described in detail with reference to Examples, but it should be understood that the present invention is not limited to the following Examples.

Resin particle dispersion, colorant particle dispersion, and releasing agent particle dispersion were separately prepared and mixed at a predetermined ratio, and the resulting dispersion was neutralized tonically by addition of a polymer of a metal salt while stirred, to give coagulation particles as the precursor for toner particles. Subsequently, after adjustment of the pH of the dispersion from weakly acidic to neutral by addition of an inorganic hydroxide, the solution was heated at a temperature of not less than the glass transition point of the resin particle to fuse the coagulated particles therein. After the reaction, the particles were washed thoroughly, separated, and dried, to give desired toner particles.

Hereinafter, each of the preparative steps will be described.

[Preparation of Resin Particle Dispersion (1)]

Styrene 480 parts
n-Butyl acrylate 120 parts
Acrylic acid 12 parts
Dodecanethiol 12 parts (reagents heretofore, manufactured by Wako Pure Chemical Industries)

These components were mixed and dissolved to give a solution.

Separately, 12 parts of an anionic surfactant (DOW-FAX, manufactured by Dow Chemical Company) was dispersed in 250 parts of ion-exchange water, and after addition of the solution above, the mixture was dispersed and emulsified in a flask. (Monomer emulsion A)

In addition, 1 part of an anionic surfactant (DOW-FAX, manufactured by Rhodia) was dissolved in 555 parts of ion-exchange water in the similar manner, and the resulting solution was fed into the polymerization flask. Subsequently, the polymerization flask was sealed, stirred, and heated mildly to 75° C. in a water bath under reflux and a nitrogen atmosphere.

A solution of 9 parts of ammonium persulfate (manufactured by Wako Pure Chemical Industries) in 43 parts of ion-exchange water was added dropwise via a metering pump into the polymerization flask over a period of 20 minutes, and then the monomer emulsion A via a metering pump over a period of 200 minutes.

After then, the polymerization flask containing the mixture was kept at 75° C. while stirring gently for 3 hours to complete polymerization. In this manner, an anionic resin particle dispersion (1) containing resin particles having an average diameter of 240 nm, a glass transition point of 54° C., a weight-average molecular weight of 25,000, and an amount of solid matter of 42% was obtained.

[Preparation of Resin Particle Dispersion (2)]

An anionic resin particle dispersion (2) containing resin particles having an average diameter of 210 nm, a glass transition point of 51° C., a weight-average molecular weight of 20,000, and an amount of solid matter of 42% was obtained in the similar manner to resin particle dispersion (1), except that the amount of acrylic acid used was changed to 9 parts and of dodecanethiol to 15 parts.

[Preparation of Colorant Particle Dispersion (1)]

Yellow pigment (PY74, manufactured by Clariant Japan K.K) 50 parts

Anionic surfactant (Neogen R, manufactured by Dai-Ichi Kogyo Seiyaku Co., Ltd) 5 parts Ion-exchange water 200 parts These components were mixed and dispersed for 10 minutes by using a homogenizer (Ultra-Turrax, manufactured by IKA®), to give a particle dispersion (1) containing yellow colorant particles having an average diameter of 200 nm and an amount of solid matter of 21.5%.

[Preparation of Colorant Particle Dispersion (2)]

A cyan colorant particle dispersion (2) containing cyan colorant particles having an average diameter of 190 nm and a solid matter content of 21.5% was obtained in the similar manner to colorant particle dispersion (1), except that a cyan pigment (copper phthalocyanine B15:3, manufactured by Dainichiseika Color & Chemicals Mfg.) was used replacing the yellow pigment used in the preparation of colorant particle dispersion (1).

[Preparation of Colorant Particle Dispersion (3)]

A magenta colorant particle dispersion (3) containing magenta colorant particles having an average diameter of 160 nm and a solid matter content of 21.5% was prepared in the similar manner to colorant particle dispersion (1), except that a magenta pigment (PR122, manufactured by Dainippon Ink and Chemicals, Inc.) was used replacing the yellow pigment used in the preparation of colorant particle dispersion (1).

[Preparation of Colorant Particle Dispersion (4)]

A black colorant particle dispersion (4) containing black colorant particles having an average diameter of 170 nm and a solid matter content of 21.5% was prepared in the similar manner to colorant particle dispersion (1), except that a black pigment (carbon black, manufactured by Cabot) was used replacing the yellow pigment used in the preparation of colorant particle dispersion (1).

[Preparation of Releasing Agent Particle Dispersion]

POLYWAX 725 (manufactured by Toyo-Petrolite, melting point: 100° C.) 50 parts

Anionic surfactant (DowFax manufactured by Dow Chemical Company) 5 parts

Ion-exchange water 200 parts

These components were heated to 110° C., blended sufficiently in a homogenizer (Ultra-Turrax T50, manufactured by IKA), and then dispersed in a high-pressure extrusion homogenizer (Gaulin homogenizer, manufactured by APV Gaulin), to give a releasing agent particle dispersion containing releasing agent particles having an average diameter of 150 nm and a solid matter content of 21.0%.

[Preparation of Toner Particle (1)]

Resin particle dispersion (1) 200 parts (resin: 84.00 parts)

Coloring agent particle dispersion (1) 40 parts (pigment: 8.60 parts)

Releasing agent particle dispersion 30 parts (releasing agent: 6.45 parts)

Polyaluminum chloride 0.15 part

These components are mixed and dispersed in a round-bottom stainless steel flask sufficiently by using a homogenizer (Ultra-Turrax T50, manufactured by IKA), and the mixture in the flask was heated to 48° C. while stirred in a heated oil bath, left at 48° C. for 60 minutes, and after addition of 68 parts of resin particle dispersion (1) (resin: 28.56 parts), the mixture was stirred mildly. Subsequently, the mixture was heated to 49° C. and left at the same temperature for 60 minutes, and then it was confirmed that the particles has a narrower grain size distribution by using a Coulter counter.

Then, the mixture was adjusted to a pH of 6.5 by addition of 0.5 mol/L aqueous sodium hydroxide solution, and heated to 95° C. while stirred continuously. The pH of the mixture dropped to 5.2 during the increase in temperature to 95° C., but the solution was kept as it was.

After reaction, the mixture was cooled and filtered. The particles thus obtained were washed thoroughly in ion-exchange water and were separated by filtration under reduced pressure by means of a Nutsche filter. The particles were redispersed in 3 liters of ion-exchange water at 40° C. and washed by stirring the dispersion at 300 rpm for 15 minutes. The washing procedures were repeated five times, and the particles were separated with a Nutsche filter under reduced pressure and then dried under vacuum for 12 hours to give a toner particle.

[Preparation of Toner Particle (2)]

Toner particle (2) was obtained in the similar manner to toner particle (1), except that the colorant particle dispersion (1) used in the preparation of toner particle (1) was replaced with colorant particle dispersion (2).

[Preparation of Toner Particle (3)]

Toner particle (3) was obtained in the similar manner to toner particle (1), except that the colorant particle dispersion (1) used in the preparation of toner particle (1) was replaced with colorant particle dispersion (3).

[Preparation of Toner Particle (4)]

Toner particle (4) was obtained in the similar manner to toner particle (1), except that the colorant particle dispersion (1) used in the preparation of toner particle (1) was replaced with colorant particle dispersion (4).

[Preparation of Toner Particle (5)]

Toner particle (5) was obtained in the similar manner to toner particle (1), except that the resin particle dispersion (1) used in the preparation of toner particle (1) was replaced with resin particle dispersion (2) and the PH during heating to 95° C. was kept at 4.0.

[Preparation of Toner Particle (6)]

Toner particle (6) was obtained in the similar manner to toner particle (1), except that the PH during heating to 95° C. in the preparation of toner particle (1) was kept at 6.5.

[Preparation of Toner Particle (7)]

Toner particle (7) was obtained in the similar manner to toner particle (1), except that the amount of polyaluminum chloride used in the preparation of toner particle (1), 0.15 part, was changed to 0.09 part.

[Preparation of Intermediate Transfer Belt (1)]

(Base Support)

To a solution of a polyamic acid consisting of 3,3',4,4'-biphenyltetracarboxylic acid dianhydride (BPDA) and p-phenylene diamine (PDA) in N-methyl-2-pyrrolidone (NMP) [U-Varnish S (solid matter: 18 wt %), manufactured by Ube Industries, LTD], 15 parts of a dried acidic carbon black (SPECIAL BLACK 4, manufactured by Degussa, pH 4.0, volatile components: 14.0%) was added with respect to 100 parts of the polyimide resin solid matter, and the mixture was mixed in a ball mill at room temperature for 6 hours. The carbon black-dispersed polyamic acid solution was then applied onto the internal surface of a cylindrical metal mold via a dispenser to a thickness of 0.3 mm; and after the coated film was made more uniform in thickness by rotating the resulting mold at 1,500 rpm for 15 minutes, the metal mold was heated externally with heated air at 60° C. for 30 minutes while being rotated at 250 rpm and additionally heated at 150° C. for 60 minutes, and then cooled to room temperature. The resulting film was removed from the metal mold, wrapped around the external surface of an iron core, and heated additionally at 400° C. for 1 hour, for removal of the solvent and the water generated by dehydrating ring closure as well as for completion of the imidation reaction. The film was then cooled to room temperature and removed from the metal mold, to give a desired base support. The thickness of the base support was 0.05 mm, and the volumetric resistivity thereof, $3\times10^{10}$ Ωcm, and the Young's modulus, 6,000 MPa.

(Elastic Layer)

Seven parts of acetylene black (granular acetylene black described above) and 20 parts of thermal black (Asahi Thermal FT described above) were blended with 100 parts of a rubber material containing NBR and EPDM at a weight ratio of 4:6 (NE40; manufactured by Nihon Gosei Gomu Co. ,Ltd) in a triple roll. A blend in a sheet form having a thickness of 0.2 mm was prepared by means of a calendar roll. The sheet was laminated onto the base support under pressure, and the resulting laminate was heated at a temperature of 150° C. under a pressure of 5.5 kg/cm$^2$ for 60 minutes for vulcanization of the elastic material, to give a two-layer belt.

The hardness of the elastic layer was 70° C. as determined according to JIS A hardness, and the volumetric resistivity was $5\times10^{10}$ Ωcm.

(Surface Layer)

A conductive fluorine resin paint, NF-7400 manufactured by Daikin Industries, containing a fluorinated carbon was applied onto the outer surface of the two-layer belt to a thickness of 20 μm, and the resulting film was heated at 150° C. for 10 minutes, to give a three-layer belt. The volumetric resistivity of the surface layer was $1\times10^{11}$ Ωcm.

The surface microhardness of the intermediate transfer belt (1) thus prepared was 9.5 mN/μm$^2$.

[Preparation of Intermediate Transfer Belt (2)]

(Base Support)

To a solution of a polyamic acid consisting of 3,3',4,4'-biphenyltetracarboxylic acid dianhydride (BPDA) and 4,4'-diaminodiphenylether (DDE) in N-methyl-2-pyrrolidone (NMP), [U-Varnish A (solid matter: 18 wt %), manufactured by Ube Industries], 15 parts of dried acidic carbon black (SPECIAL BLACK 4 (manufactured by Degussa, pH 4.0, volatile components: 14.0%) was added with respect to 100 parts of the polyimide resin solid matter, and the mixture was mixed in a ball mill at room temperature for 6 hours. The carbon black-dispersed polyamic acid solution was then applied onto the internal surface of cylindrical metal mold via a dispenser to a thickness of 0.5 mm; and after the coated film was made more uniform in thickness by rotating the resulting mold at 1,500 rpm for 15 minutes, the metal mold was heated externally with heated air at 60° C. for 30 minutes while being rotated at 250 rpm, heated at 150° C. for 60 minutes, and then cooled to room temperature. The resulting film was removed from the metal mold, wrapped around the external surface of an iron core, and heated additionally at 350° C. for 1 hour, for removal of the solvent and the water generated by dehydrating ring closure as well as for completion of the imidation reaction. Subsequently, the film was cooled to room temperature and removed from the metal mold, to give a desired base support. The thickness of the base support was 0.08 mm; the volumetric resistivity, $5\times10^{10}$ Ωcm; and the Young's modulus, 3,500 MPa.

(Elastic Layer)

An elastic layer was formed in the similar manner to the elastic layer of intermediate transfer belt (1), except that the thickness of the elastic layer in the preparation of the intermediate transfer belt (1), 0.2 mm, was changed to 0.3 mm.

The hardness of the elastic layer was 55° C. as determined according to JIS A hardness, and the volumetric resistivity was $5\times10^{10}$ Ωcm.

(Surface Layer)

A surface layer was formed in the similar manner to the surface layer of intermediate transfer belt (1). The volumetric resistivity of the surface layer was $1\times10^{11}$ Ωcm.

The surface microhardness of the intermediate transfer belt (2) thus prepared was 7.0 mN/μm$^2$.

[Preparation of Intermediate Transfer Belt (3)]

An intermediate transfer belt (3) was prepared in the similar manner to intermediate transfer belt (2), except that the same material as those used for intermediate transfer belt (2) were employed but the rubber JIS A hardness of the elastic layer was 40 and the thickness was 0.3 mm.

The surface microhardness of the intermediate transfer belt (3) thus prepared was 4.0 mN/μm$^2$.

[Preparation of Intermediate Transfer Belt (4)]

(Base Support)

To a solution of a polyamic acid consisting of 3,3',4,4'-biphenyltetracarboxylic acid dianhydride (BPDA) and p-phenylene diamine (PDA) in N-methyl-2-pyrrolidone (NMP), [(U-Varnish S (solid matter: 18 wt %), manufactured by Ube Industries), 15 parts of acetylene black (manufactured by Denki Kagaku Kogyo, pH: 5.7, volatile components: 0.89%) was added with respect to 100 parts of the polyimide resin solid matter, and the mixture was mixed in a ball mill at room temperature for 6 hours. Subsequently, the carbon black-dispersed polyamic acid solution was applied onto the internal surface of a cylindrical metal mold via a dispenser to a thickness of 0.5 mm; and after the coated film was made more uniform in thickness by rotating the resulting mold at 1,500 rpm for 15 minutes, the metal mold was heated externally with heated air at 60° C. for 30 minutes while being rotated at 250 rpm and additionally heated at 150° C. for 60 minutes, and then cooled to room temperature. The resulting film was removed from the metal mold, wrapped around the external surface of an iron core, and heated additionally at 400° C. for 1 hour, for removal of the solvent and the water generated by dehydrating ring closure as well as for completion of the imidation reaction. The film was then cooled to room temperature and removed from the metal mold, to give a desired base support. The thickness of the base support was 0.08 mm; the volumetric resistivity, $2\times10^{10}$ Ωcm; and the Young's modulus, 600 MPa.

(Surface Layer)

In preparation of this intermediate transfer belt (4), an FEP resin-containing fluorine rubber-based paint containing 6% by weight of carbon black dispersed therein (Daiel Latex NF-915: manufactured by Daikin Industries, Ltd.) was applied by spray coating directly onto the base support surface without an elastic layer, and the resulting film was heated at 200° C. for 30 minutes, to give a carbon black-dispersed fluorine rubber-based coated layer having a thickness of 50 μm as the surface layer. The volumetric resistivity of the fluorine rubber-based surface layer was $2\times10^{11}$ Ωcm.

The surface microhardness of the intermediate transfer belt (4) thus prepared was 40 mN/μm$^2$.

[Preparation of Intermediate Transfer Belt (5)]

A film was prepared in the similar manner to intermediate transfer belt (1). After heating at 150° C. for 60 minutes and subsequent cooling to room temperature, the film was removed from the metal mold, wrapped around an iron substrate, and heated additionally at 450° C. for 1 hour under tension, to give a base support having a thickness of 0.05 mm, a volumetric resistivity of $3.1\times10^{10}$ Ωcm, and a Young's modulus of 1,000 MPa.

(Elastic Layer)

An elastic layer was formed in the similar manner to the elastic layer of intermediate transfer belt (1), except that the thickness of 0.2 mm in the preparation of the elastic layer of intermediate transfer belt (1) was changed to 0.1 mm.

The hardness of the elastic layer as determined according to JIS A hardness was 65° C.; and the volumetric resistivity was $5\times10^{10}$ Ωcm.

(Surface Layer)

A surface layer was formed in the similar manner to the surface layer of intermediate transfer belt (1). The volumetric resistivity of the surface layer was $1\times10^{11}$ Ωcm.

The surface microhardness of the intermediate transfer belt (5) thus prepared was 10.5 mN/μM$^2$.

EXAMPLE 1

1.2 Parts of hydrophobic silica (TS720, manufactured by Cabot) was added to 50 parts of toner particles (1), and the mixture was blended in a sample mill, to give external additive toner particles.

The external additive toner particles were weighed in an amount of 5% as toner concentration with respect to a ferrite carrier, which consists of a ferrite core (average particle diameter: 50 μm, manufactured by POWDERTECH CORP.) and polymethyl methacrylate (weight-average molecular weight: 50,000, manufactured by Soken Chemical & Engineering) covering the same in an amount of 1%, and these particles were mixed and blended in a ball mill for 5 minutes, to give a developer.

In an image-forming apparatus having the same configuration as that of the image-forming apparatus shown in FIG. 1, the intermediate transfer belt thereof is replaced with intermediate transfer belt (1), and a developer containing toner particles (1) was placed in the toner container. Analysis of the diameter of toner particles contained in the toner container of this image-forming apparatus by a Coulter counter revealed that the cumulative volume average particle diameter D50 was 5.4 μm; the smaller-side grain size distribution index GSDpS, 1.22; and the surface roughness index, 1.55. In addition, the shape factor SF-1 of the toner particles as determined by visual observation using Luzex was 130.

In addition, images were formed in this image-forming apparatus, and the quality of the images was evaluated. In this image quality evaluation, frequencies of disconnection of image (hollow character), scattering of toner particles (blur), and out-of-color registration (irregular registration) were determined. These results are summarized in the following Table 1.

TABLE 1

| | Example | | | | | | | | Comparative example | | |
|---|---|---|---|---|---|---|---|---|---|---|---|
| | 1 | 2 | 3 | 4 | 5 | 6 | 7 | 8 | 1 | 2 | 3 |
| Toner particle | 1 | 2 | 3 | 4 | 5 | 6 | 1 | 1 | 7 | 1 | 1 |
| Intermediate transfer belt | 1 | 1 | 1 | 1 | 1 | 1 | 2 | 3 | 1 | 4 | 5 |
| GSDpS | 1.22 | 1.23 | 1.22 | 1.21 | 1.21 | 1.22 | 1.22 | 1.22 | 1.27 | 1.22 | 1.22 |
| SF-1 | 130 | 131 | 133 | 129 | 120 | 146 | 103 | 130 | 127 | 130 | 130 |
| Surface roughness index | 1.55 | 1.57 | 1.60 | 1.54 | 1.25 | 2.15 | 1.55 | 1.55 | 1.60 | 1.55 | 1.55 |
| Young's modulus of base support (Mpa) | 6000 | 6000 | 6000 | 6000 | 6000 | 6000 | 3500 | 3500 | 6000 | 600 | 10000 |
| Surface microhardness (mN/μm$^2$) | 9.5 | 9.5 | 9.5 | 9.5 | 9.5 | 9.5 | 7.0 | 4.0 | 9.5 | 40 | 10.5 |
| Hollow character | A | A | A | A | A | B | A | A | B | C | C |
| Blur | A | A | A | A | A | A | A | A | C | C | C |
| Irregular registration | A | A | A | A | A | A | A | A | C | C | C |

In Table 1, "A" indicates that there were no defaults in each image quality, and "B" indicates that there were slight defaults but practically no problems in image quality. On the other hand, "C" indicates that there were some defaults in each image, resulting in problems in image quality.

EXAMPLE 2

A developer was prepared in the similar manner to Example 1, except that toner particle (1) was changed to toner particle (2). In an image-forming apparatus having the same configuration as that of the image-forming apparatus shown in FIG. 1, the intermediate transfer belt thereof is replaced with intermediate transfer belt (1), and a developer containing toner particle (2) was placed in the toner container. Analysis of the diameter of toner particles contained in the toner container of this image-forming apparatus by a Coulter counter revealed that the cumulative volume average particle diameter D50 was 5.3 μm; the smaller-side grain size distribution index GSDpS, 1.23; the surface roughness index, 1.57; and the shape factor SF-1, 131.

Images were formed also in this image-forming apparatus, and results of the image quality evaluation are summarized in Table 1.

EXAMPLE 3

A developer was prepared in the similar manner to Example 1, except that toner particle (1) was changed to toner particle (3). In an image-forming apparatus having the same configuration as that of the image-forming apparatus shown in FIG. 1, the intermediate transfer belt thereof is replaced with intermediate transfer belt (1), and a developer containing toner particle (3) was placed in the toner container. Analysis of the diameter of toner particles contained in the toner container of this image-forming apparatus by a Coulter counter revealed that the cumulative volume average particle diameter D50 was 5.4 μm; the smaller-side grain size distribution index GSDpS, 1.22; the surface roughness index, 1.60; and the shape factor SF-1, 133.

In addition, images were formed in this image-forming apparatus, and the quality of the images was evaluated. The results are summarized in Table 1.

EXAMPLE 4

A developer was prepared in the similar manner to Example 1, except that toner particle (1) was changed to toner particle (4). In an image-forming apparatus having the same configuration as that of the image-forming apparatus shown in FIG. 1, the intermediate transfer belt thereof is replaced with intermediate transfer belt (1), and a developer containing toner particle (4) was placed in the toner container. Analysis of the diameter of toner particles contained in the toner container of this image-forming apparatus by a Coulter counter revealed that the cumulative volume average particle diameter D50 was 5.5 μm; the smaller-side grain size distribution index GSDpS, 1.21; the surface roughness index, 1.54; and the shape factor SF-1, 129.

In addition, images were formed in this image-forming apparatus, and the quality of the images was evaluated. The results are summarized in Table 1.

EXAMPLE 5

A developer was prepared in the similar manner to Example 1, except that toner particle (1) was changed to toner particle (5). In an image-forming apparatus having the same configuration as that of the image-forming apparatus shown in FIG. 1, the intermediate transfer belt thereof is replaced with intermediate transfer belt (1), and a developer containing toner particle (5) was placed in the toner container. Analysis of the diameter of toner particles contained in the toner container of this image-forming apparatus by a Coulter counter revealed that the cumulative volume average particle diameter D50 was 5.3 μm; the smaller-side grain size distribution index GSDpS, 1.21; the surface roughness index, 1.25; and the shape factor SF-1, 120.

In addition, images were formed in this image-forming apparatus, and the quality of the images was evaluated. The results are summarized in Table 1.

EXAMPLE 6

A developer was prepared in the similar manner to Example 1, except that toner particle (1) was changed to toner particle (6). In an image-forming apparatus having the same configuration as that of the image-forming apparatus shown in FIG. 1, the intermediate transfer belt thereof is replaced with intermediate transfer belt (1), and a developer containing toner particle (6) was placed in the toner container. Analysis of the diameter of toner particles contained in the toner container of this image-forming apparatus by a Coulter counter revealed that the cumulative volume average particle diameter D50 was 5.3 μm; the smaller-side grain size distribution index GSDpS, 1.22; the surface roughness index, 2.15; and the shape factor SF-1, 146.

In addition, images were formed in this image-forming apparatus, and the quality of the images was evaluated. The results are summarized in Table 1.

EXAMPLE 7

A developer was prepared in the similar manner to Example 1, by using toner particle (1). In an image-forming apparatus having the same configuration as that of the image-forming apparatus shown in FIG. 1, the intermediate transfer belt thereof is replaced with intermediate transfer belt (2), and a developer containing toner particle (1) was placed in the toner container.

Images were also formed in this image-forming apparatus, and the quality of the images was evaluated. The results are summarized in Table 1.

EXAMPLE 8

A developer was prepared in the similar manner to Example 1, by using toner particle (1). In an image-forming apparatus having the same configuration as that of the image-forming apparatus shown in FIG. 1, the intermediate transfer belt thereof is replaced with intermediate transfer belt (3), and a developer containing toner particle (1) was placed in the toner container.

Images were also formed in this image-forming apparatus, and the quality of the images was evaluated. The results are summarized in Table 1.

COMPARATIVE EXAMPLE 1

A developer was prepared in the similar manner to Example 1, except that toner particle (1) was changed to toner particle (7). In an image-forming apparatus having the same configuration as that of the image-forming apparatus shown in FIG. 1, the intermediate transfer belt thereof is replaced with intermediate transfer belt (1), and a developer containing toner particle (7) was placed in the toner container. Analysis of the diameter of toner particles contained in the toner container of this image-forming apparatus by a Coulter counter revealed that the cumulative volume average particle diameter D50 was 5.1 μm; the smaller-side grain size distribution index GSDpS, 1.27; the surface roughness index, 1.60; and the shape factor SF-1, 127.

In addition, images were also formed in this image-forming apparatus, and the quality of the images was evaluated. The results are summarized in Table 1.

COMPARATIVE EXAMPLE 2

A developer was prepared in the similar manner to Example 1, by using toner particle (1). In an image-forming apparatus having the same configuration as that of the image-forming apparatus shown in FIG. 1, the intermediate transfer belt thereof is replaced with intermediate transfer belt (4), and a developer containing toner particle (1) was placed in the toner container.

Images were also formed in this image-forming apparatus, and the quality of images was evaluated. The results are summarized in Table 1.

COMPARATIVE EXAMPLE 3

A developer was prepared in the similar manner to Example 1, by using toner particle (1). In an image-forming apparatus having the same configuration as that of the image-forming apparatus shown in FIG. 1, the intermediate transfer belt thereof is replaced with intermediate transfer belt (5), and a developer containing toner particle (1) was placed in the toner container.

Images were also formed in this image-forming apparatus, and the quality of the images was evaluated. The results are summarized in Table 1.

High-quality images were obtained in each of the Examples above. Comparison of the results of image quality evaluation in each Example and that in Comparative Example 1 reveals that the smaller-side grain size distribution index GSDpS of the toner particles contained in the toner container should be 1.24 or less for obtaining high-quality images. In addition, comparison of the results of image quality evaluation in each Example with those of Comparative Examples 1 and 2 reveals that the Young's modulus of the base support of the intermediate transfer belt should be 3,500 MPa or more and 9,000 MPa or less and the surface microhardness of the intermediate transfer belt, 10 $mN/\mu m^2$ or less.

Further, comparison between the frequencies of hollow characters in Example 6 and those in Examples 1 and 3 reveals that for complete prevention of the incidence of hollow characters, the surface roughness index of the toner particles contained in the toner container should be 2.0 or less, and the shape factor SF-1 of the toner particles should be 140 or less.

As described above, in the image-forming apparatus according to the present invention, toner particles having a flatness coefficient SF-1 of 140 or less may be contained in the toner container, the flatness coefficient being expressed by Formula 2:

$$SF\text{-}1=|(MXLNG)^2/\mathrm{AREA}|\times(\pi/4)\times 100 \qquad \text{Formula 2,}$$

(wherein, MXLNG represents the maximum diameter of a toner particle; and AREA represents the projected area of the toner particle).

Also, in the image-forming apparatus according to the present invention, toner particles having a surface roughness index of 2.0 or less may be contained in the toner container, the surface roughness index being expressed by Formula 3:

$$\text{Surface roughness index}=\text{Measured specific surface area}/\text{Calculated specific surface area} \qquad \text{Formula 3}$$

(wherein, the calculated specific surface area represents a value calculated according to the following Formula 4, using the particle count n and the particle diameter R of the toner particles falling in each of 16 grain ranges partitioned based on the particle count distribution in diameter ranges as determined by using a Coulter counter, and the density of the toner particles ρ:

$$\text{Calculated specific surface area}=6\Sigma(n\times R^2)/|\rho\times\Sigma(n\times R^3)| \qquad \text{Formula 4).}$$

In the image-forming apparatus according to the present invention, a toner including a binder resin having a weight-average molecular weight Mw of 15,000 or more and 50,000 or less may be contained in the toner container.

In the image-forming apparatus according to the present invention, a toner further including a releasing agent may be contained in the toner container.

In the image-forming apparatus according to the present invention, a two-component developer consisting of a toner and a carrier may be contained in the toner container.

In the image-forming apparatus, the belt may have a volumetric resistivity of $1\times10^8$ or more and $1\times10^{13}$ Ωm or less.

In the image-forming apparatus according to the present invention the belt may have at least one resin selected from polyimide resins, polyamide resins, and polyether ether ester resins.

In the image-forming apparatus according to the present invention, the belt may have a polyimide resin, a conductive agent being dispersed therein.

In the image-forming apparatus according to the present invention, the belt may have a nonadhesive resin composition having a fluorine resin material as the main component.

Among the toner particles contained in the toner container, particles having a shape more like sphere or a smoother surface are smaller in the contact area with the image carrier and thus may be transferred more easily onto the intermediate transfer belt, while particles having a shape deformed or less spherical or a greater surface roughness are larger in the contact area with the image carrier and are less easily transferred onto the intermediate transfer belt. Accordingly, the image-forming apparatus according to the present invention, the shape of the toner particles contained in toner container is defined by a parameter, flatness coefficient SF-1, and the surface roughness of the toner particles contained in toner container by a parameter, surface roughness index. If the flatness coefficient SF-1 is over 140, a greater amount of deformed and less spherical toner particles are present in the toner container, which decreases the efficiency of transferring toners and provides images less uniform in quality. In addition, if the surface roughness index is over 2.0, the amount of toner particles larger in surface roughness are present in a greater amount, leading to decrease in the transfer efficiency of toners and thus providing images less uniform in quality. Although another parameter, called SF-2, is used elsewhere as a parameter for defining the surface roughness of toner particles, the parameter SF-2 often leads to errors due to its inherent problem in resolution, as the parameter is determined by analyzing the surface area of toner particles by using an optical microscope. In contrast, use of the surface roughness index above provides more accurate measured data, as it is obtained by analyzing absorption of a molecule on the toner particle surface for determining the surface area of toner particles.

Also, the image-forming method according to the present invention, toner particles having a flatness coefficient SF-1 of 140 or less may be supplied to the image carrier carrying an electrostatic latent image in the developing step, the flatness coefficient being expressed by Formula 6:

$$SF\text{-}1=|(MXLNG)^2/\mathrm{AREA}|\times(\pi/4)\times 100 \qquad \text{Formula 6}$$

(wherein, MXLNG represents the maximum diameter of a toner particle; and AREA represents the projected area of the toner).

In the image-forming method according to the present invention, toner particles having a surface roughness index of 2.0 or less may be supplied to the image carrier carrying electrostatic latent images in the developing step, the surface roughness index being expressed by Formula 7:

$$\text{Surface roughness index}=\text{Measured specific surface area}/\text{Calculated specific surface area} \quad \text{Formula 7,}$$

(wherein, the calculated specific surface area is a value calculated according to the following Formula 8, using the particle count n and the particle diameter R of the toner particles falling in each of 16 grain ranges partitioned based on the number distribution of particle diameter by as determined by using a Coulter counter, and the density of the toner particles ρ:

$$\text{Calculated specific surface area}=6\Sigma(n\times R^2)/|\rho\times\Sigma(n\times R^3)| \quad \text{Formula 8.)}$$

In the image-forming method according to the present invention, a toner further comprising a binder resin having a weight-average molecular weight Mw of 15,000 or more and 50,000 or less may be supplied to the image carrier carrying an electrostatic latent image in the developing step.

In the image-forming method according to the present invention, a toner further comprising a releasing agent may be supplied to the image carrier carrying an electrostatic latent image in the developing step.

In the image-forming method according to the present invention, a toner made of a two-component developer consisting of a toner and a carrier may be supplied to the image carrier carrying an electrostatic latent image in the developing step.

In the image-forming method according to the present invention, the image may be transferred onto the surface of the belt having a volumetric resistivity of $1\times10^8$ or more and $1\times10^{13}$ Ωm or less in the transferring step.

In the image-forming method according to the present invention, the image may be transferred onto the belt comprising at least one resin selected from polyimide resins, polyamide resins, and polyether ether ester resins in the transferring step.

In the image-forming method according to the present invention, the image may be transferred onto the belt comprising a polyimide resin, a conductive agent being dispersed therein, in the transferring step.

In the image-forming method according to the present invention, the image maybe transferred onto the belt comprising a nonadhesive resin composition having a fluorine resin material as the main component in the transferring step.

The entire disclosure of Japanese Patent Application No. 2004-021190 filed on Jan. 29, 2004 including specification, claims, drawings and abstract is incorporated herein by reference in its entirety.

What is claimed is:

1. An image-forming apparatus equipped with a toner container containing a set of toner particles and an endless belt circulating in a certain direction via nip portions in contact with image carriers carrying electrostatic latent images, that forms a toner image on a recording medium by obtaining a toner image by developing an electrostatic latent image on an image carrier carrying an electrostatic latent image by supplying the toner particles contained in the toner container thereto, transferring the toner image onto the surface of the belt at the nip portion, and transferring the toner image transferred onto the surface of the belt finally onto the recording medium and fixes the toner image thereon, wherein when the particle count distribution in diameter ranges of the toner particles contained in the toner container is expressed by Formula 1:

$$\text{Smaller-side grain size distribution index } GSDpS=(D50p/D16p)^{1/2} \quad \text{Formula 1}$$

(wherein, D50p is the particle diameter at a cumulative count rate of 50% when toner particles are counted from the smallest toner particle cumulatively, and D16p is the particle diameter at a cumulative count rate of 16%.), the toner container contains a set of toner particles having a smaller-side grain size distribution index GSDpS of 1.24 or less; and the belt comprises a base support having a Young's modulus of 3,500 MPa or more and 9,000 MPa or less and a surface microhardness of 10 mN/μm$^2$ or less.

2. The image-forming apparatus according to claim 1, wherein toner particles having a flatness coefficient SF-1 of 140 or less is contained in the toner container, the flatness coefficient being expressed by Formula 2:

$$SF\text{-}1=|(MXLNG)^2/\text{AREA}\times(\pi/4)\times100 \quad \text{Formula 2,}$$

(wherein, MXLNG represents the maximum diameter of a toner particle; and AREA represents the projected area of the toner particle).

3. The image-forming apparatus according to claim 1, wherein toner particles having a surface roughness index of 2.0 or less are contained in the toner container, the surface roughness index being expressed by Formula 3:

$$\text{Surface roughness index}=\text{Measured specific surface area}/\text{Calculated specific surface area} \quad \text{Formula 3}$$

(wherein, the calculated specific surface area represents a value calculated according to the following Formula 4, using the particle count n and the particle diameter R of the toner particles falling in each of 16 grain ranges partitioned based on the particle count distribution in diameter ranges as determined by using a Coulter counter, and the density of the toner particles ρ:

$$\text{Calculated specific surface area}=6\Sigma(n\times R^2)/|\rho\times\Sigma(n\times R^3)| \quad \text{Formula 4).}$$

4. The image-forming apparatus according to claim 1, wherein a toner further comprising a binder resin having a weight-average molecular weight Mw of 15,000 or more and 50,000 or less is contained in the toner container.

5. The image-forming apparatus according to claim 1, wherein a toner further comprising a releasing agent is contained in the toner container.

6. The image-forming apparatus according to claim 1, wherein a two-component developer consisting of a toner and a carrier is contained in the toner container.

7. The image-forming apparatus according to claim 1, wherein the belt has a volumetric resistivity of $1\times10^8$ or more and $1\times10^8$ Ωm or less.

8. The image-forming apparatus according to claim 1, wherein the belt comprises at least one resin selected from polyimide resins, polyamide resins, and polyether ether ester resins.

9. The image-forming apparatus according to claim 1, wherein the belt comprises a polyimide resin, a conductive agent being dispersed therein.

10. The image-forming apparatus according to claim 1, wherein the belt comprises a nonadhesive resin composition having a fluorine resin material as the main component.

11. An image-forming method that forms a toner image onto a recording medium, comprising a development step of obtaining a toner image by developing an electrostatic latent image on an image carrier carrying the electrostatic latent image by supplying a toner thereto; a transferring step of transferring the toner image onto an endless belt circulating in a certain direction via a nip portion in contact with the image carrier surface; and a retransferring step of retransferring the toner image transferred on the surface of the belt finally onto the recording medium and fixing the toner image thereon, wherein when the particle count distribution in diameter ranges is expressed by Formula 5:

$$\text{Smaller-side grain size distribution index } GSDpS = (D50p/D16p)^{1/2} \quad \text{Formula 5,}$$

(wherein, D50p is the particle diameter at a cumulative count rate of 50% when the number of toner particles is counted from the smallest toner particle cumulatively, and D16p is the particle diameter at a cumulative count rate of 16%.), the toner image is obtained by developing the electrostatic latent image by supplying toner particles having a smaller-side grain size distribution index GSDpS of 1.24 or less to the image carrier carrying the electrostatic latent image in the developing step, and the toner image is transferred at the nip portion onto the surface of the belt comprising a base support having a Young's modulus of 3,500 MPa or more and 9,000 MPa or less and having a surface microhardness of 10 $mN/\mu m^2$ or less in the transferring step.

12. The image-forming method according to claim 11, wherein toner particles having a flatness coefficient SF-1 of 140 or less is supplied to the image carrier carrying an electrostatic latent image in the developing step, the flatness coefficient being expressed by Formula 6:

$$SF\text{-}1 = |(MXLNG)^2/\text{AREA}| \times (\pi/4) \times 100 \quad \text{Formula 6}$$

(wherein, MXLNG represents the maximum diameter of a toner particle; and AREA represents the projected area of the toner).

13. The image-forming method according to claim 11, wherein toner particles having a surface roughness index of 2.0 or less is supplied to the image carrier carrying electrostatic latent images in the developing step, the surface roughness index being expressed by Formula 7:

$$\text{Surface roughness index} = \text{Measured specific surface area}/\text{Calculated specific surface area} \quad \text{Formula 7,}$$

(wherein, the calculated specific surface area is a value calculated according to the following Formula 8, using the particle count n and the particle diameter R of the toner particles falling in each of 16 grain ranges partitioned based on the number distribution of particle diameter by as determined by using a Coulter counter, and the density of the toner particles ρ:

$$\text{Calculated specific surface area} = 6\Sigma(n \times R^2)/|\rho \times \Sigma(n \times R^3)| \quad \text{Formula 8.).}$$

14. The image-forming method according to claim 11, wherein a toner further comprising a binder resin having a weight-average molecular weight Mw of 15,000 or more and 50,000 or less is supplied to the image carrier carrying an electrostatic latent image in the developing step.

15. The image-forming method according to claim 11, wherein a toner further comprising a releasing agent is supplied to the image carrier carrying an electrostatic latent image in the developing step.

16. The image-forming method according to claim 11, wherein a toner made of a two-component developer consisting of a toner and a carrier is supplied to the image carrier carrying an electrostatic latent image in the developing step.

17. The image-forming method according to claim 11, wherein the image is transferred onto the surface of the belt having a volumetric resistivity of $1\times10^8$ or more and $1\times10^{13}$ Ωm or less in the transferring step.

18. The image-forming method according to claim 11, wherein the image is transferred onto the belt comprising at least one resin selected from polyimide resins, polyamide resins, and polyether ether ester resins in the transferring step.

19. The image-forming method according to claim 11, wherein the image is transferred onto the belt comprising a polyimide resin, a conductive agent being dispersed therein, in the transferring step.

20. The image-forming method according to claim 11, wherein the image is transferred onto the belt comprising a nonadhesive resin composition having a fluorine resin material as the main component in the transferring step.

* * * * *